US011247464B2

(12) United States Patent
Kaiba et al.

(10) Patent No.: US 11,247,464 B2
(45) Date of Patent: Feb. 15, 2022

(54) VALVE TYPE NOZZLE AND LIQUID DISCHARGE APPARATUS

(71) Applicant: Ricoh Company, Ltd., Tokyo (JP)

(72) Inventors: Tadashi Kaiba, Hachioji (JP); Shuusei Murai, Machida (JP)

(73) Assignee: RICOH COMPANY, LTD., Tokyo (JP)

( * ) Notice: Subject to any disclaimer, the term of this patent is extended or adjusted under 35 U.S.C. 154(b) by 50 days.

(21) Appl. No.: 16/915,618

(22) Filed: Jun. 29, 2020

(65) Prior Publication Data

US 2020/0324312 A1 Oct. 15, 2020
US 2021/0316328 A9 Oct. 14, 2021

Related U.S. Application Data

(63) Continuation of application No. 16/249,388, filed on Jan. 16, 2019, now Pat. No. 10,737,490.

(30) Foreign Application Priority Data

Jan. 16, 2018 (JP) ..... 2018-004682

(51) Int. Cl.
*B41J 2/14* (2006.01)
*B05C 5/02* (2006.01)
*B41J 3/407* (2006.01)

(52) U.S. Cl.
CPC ..... *B41J 2/14201* (2013.01); *B05C 5/0229* (2013.01); *B41J 2/1433* (2013.01); *B41J 3/4073* (2013.01); *B41J 2202/05* (2013.01)

(58) Field of Classification Search
CPC ..... B41J 2202/05
See application file for complete search history.

(56) References Cited

U.S. PATENT DOCUMENTS

2004/0050974 A1 3/2004 Lee et al.
2009/0167818 A1 7/2009 Morita
(Continued)

FOREIGN PATENT DOCUMENTS

EP 2641661 A1 9/2013
EP 2799150 A1 11/2014
GB 2516846 A * 2/2015 ..... B41J 2/14
(Continued)

OTHER PUBLICATIONS

EPO Search Report for corresponding application No. 19151795.2-1019, dated May 27, 2019 (9 pages).

*Primary Examiner* — Shelby L Fidler
(74) *Attorney, Agent, or Firm* — Flynn Thiel, P.C.

(57) ABSTRACT

A valve type nozzle controls discharge of liquid by opening and closing an discharge port by a valve element, the discharge port being configured to discharge the liquid, and the valve element being formed movably by applying a predetermined voltage to a piezoelectric element, whereby when the predetermined voltage is applied to the piezoelectric element, the valve element moves in a direction where the moving mechanism opens the discharge port when the piezoelectric element extends. This allows the liquid to be discharged. Further, when the application of the voltage to the piezoelectric element is released, the moving mechanism returns to an original shape, by which the valve element closes the discharge port is closed to prevent the discharge of the liquid.

11 Claims, 7 Drawing Sheets

(56) References Cited

U.S. PATENT DOCUMENTS

| | | | | |
|---|---|---|---|---|
| 2010/0321448 | A1 | 12/2010 | Buestgens et al. | |
| 2014/0192117 | A1 * | 7/2014 | Obertegger | B41J 2/175 347/54 |

FOREIGN PATENT DOCUMENTS

| | | | | |
|---|---|---|---|---|
| JP | 4123897 | B2 | | 7/2008 |
| JP | 2011230122 | A | * | 11/2011 |
| WO | 2016032746 | A1 | | 3/2016 |

* cited by examiner

VALVE TYPE NOZZLE AND LIQUID DISCHARGE APPARATUS

This is a continuation of U.S. Ser. No. 16/249,388, filed Jan. 16, 2019, which claims priority to Japanese Application No. 2018-4682, filed Jan. 16, 2018, all of which are hereby incorporated by reference in their entireties.

BACKGROUND

Technical Field

The present invention relates to a valve type nozzle and a liquid discharge apparatus, and more particularly to a valve type nozzle and a liquid discharge apparatus suitable for a coating apparatus, an automatic drawing apparatus and the like.

Related Art

As an inkjet nozzle of a coating apparatus that paints or prints on a vehicle body or the like, there is a type using a valve type inkjet nozzle described in JP 4123897 B2, for example. While this valve type inkjet nozzle uses an electromagnetic driving mechanism as driving means for opening and closing a valve, there is also a conventional example using a piezoelectric driving mechanism in order to increase a driving speed (opening/closing speed) of a valve. One conventional example of the valve type inkjet nozzle using the above-described piezoelectric driving mechanism is shown in FIGS. 3A and 3B. FIG. 3A is a cross-sectional view of a valve type inkjet nozzle using a conventional piezoelectric driving mechanism showing a state where a discharge port is closed, and FIG. 3B is a cross-sectional view of the valve type inkjet nozzle conventional piezoelectric driving mechanism showing a state where the discharge port is opened.

The illustrated conventional valve type inkjet nozzle 100 has a hollow nozzle body 101 provided with an discharge port 102 for discharging ink at a tip thereof and provided with an injection port 103 in the vicinity of the discharge port 102, a piezoelectric element 104 embedded in the nozzle body 101, and extending and contracting (extending and contracting in a left-right direction in FIGS. 3A and 3B) in accordance with application of a voltage from an outside, a valve element 105 fixed to a tip side of the extending and contracting piezoelectric element 104 to open and close the discharge port 102, a sealing member 106 fitted onto the valve element 105 to prevent ink from flowing into a piezoelectric element 104 side, and a pair of lead wires 107 and 108 for voltage application connected to electrodes of the piezoelectric element 104.

When a predetermined voltage (EV) is applied to the piezoelectric element 104 through the lead wires 107 and 108 of the valve type inkjet nozzle 100, the piezoelectric element 104 extends in a longitudinal direction, by which the valve element 105 moves to a left side of FIG. 3A and closes the discharge port 102. Therefore, the discharge of ink 109 from the discharge port 102 is blocked. When the application of the voltage to the piezoelectric element 104 is 0 V, that is, when no voltage is applied, the piezoelectric element 104 returns to an original state (an original shape), by which as shown in FIG. 3B, the discharge port 102 is opened, and the ink 109 is discharged from the discharge port 102 to perform coating or the like. Since the piezoelectric element 104 has a characteristic of being destroyed when a negative voltage (−EV) is applied, a negative voltage cannot be applied.

SUMMARY

In the conventional valve type inkjet nozzle using the above-described piezoelectric element 104, when the ink need not be discharged, the predetermined voltage need be applied to the piezoelectric element 104 to keep the discharge port 102 closed by the valve element 105. However, if the applied voltage drops or power failure occurs due to any trouble, the piezoelectric element 104 returns to the original shape, the valve element 105 opens the discharge port 102, and as a result, the ink 109 leaks from the discharge port 102. Ink leakage not only causes a large amount of unnecessary consumption of the ink 109 but also causes a problem that the leaking ink 109 contaminates a periphery of the discharge port 102 and causes nozzle clogging.

The present invention has been achieved in light of the above problems, and it is an object of the present invention to provide a valve type nozzle and a liquid discharge apparatus that prevents liquid leakage from a discharge port even when an applied voltage becomes zero during continuation of voltage application to a piezoelectric element.

In order to solve the above-mentioned problems, the invention according to (1) is characterized in that in a valve type nozzle that controls discharge of liquid by opening and closing an discharge port by a valve element, the discharge port being configured to discharge the liquid, and the valve element being formed movably by applying a predetermined voltage to a piezoelectric element, wherein a moving mechanism is interposed between the piezoelectric element and the valve element, and the predetermined voltage is applied to the piezoelectric element to move the valve element by the moving mechanism so as to open the discharge port, and further, the predetermined voltage applied to the piezoelectric element is released to move the valve element by the moving mechanism so as to close the discharge port.

In order to solve the above-mentioned problems, the invention according to (2) is characterized in that in the valve type nozzle according to (1), wherein the moving mechanism is formed so that a movement length of the valve element is longer than a extension length of the piezoelectric element when the predetermined voltage is applied to the piezoelectric element.

In order to solve the above-mentioned problems, the liquid discharge apparatus according to (3) is characterized in that comprising: a liquid discharge head having a valve type nozzle according to (1) or (2), a liquid discharge head moving mechanism moving the liquid discharge head.

According to the valve type nozzle or the liquid discharge apparatus of the present invention, since the configuration is such that by disposing the moving mechanism between the piezoelectric element and the valve element, the valve element closes the discharge port when the applied voltage is 0, there is an effect that the liquid can be prevented from leaking from the discharge port even if the applied voltage becomes 0 or a power failure occurs due to any trouble. As a result, there are effects that the liquid is prevented from being wastefully consumed in large quantities, and that nozzle clogging due to leaking liquid is also prevented from occurring.

DETAILED DESCRIPTION

Configuration of Valve Type Inkjet Nozzle

Figure 1A:
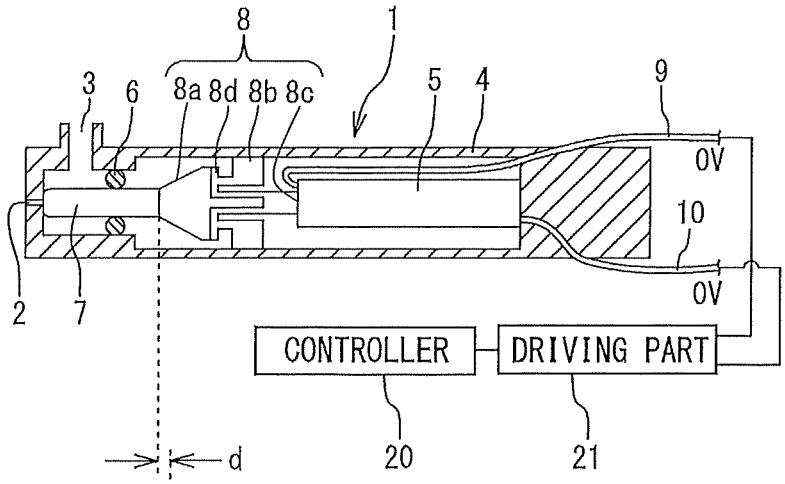
FIG. 1A is a cross-sectional view of an embodiment of a valve type inkjet nozzle according to the present invention showing a state where an discharge port is closed.
Figure 1B:
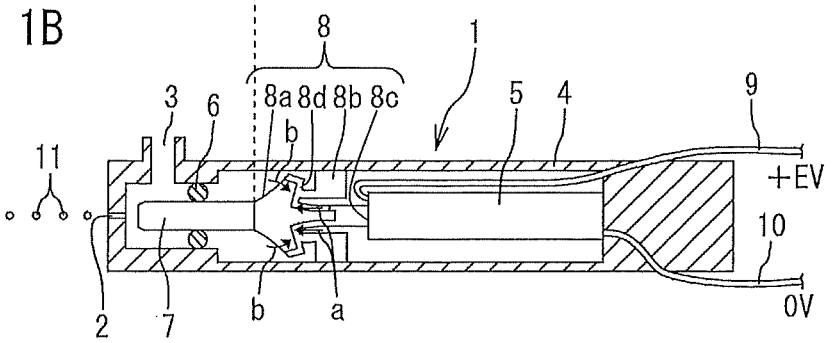
FIG. 1B is a cross-sectional view of the embodiment of the valve type inkjet nozzle according to the present invention showing a state where the discharge port is opened.

Hereinafter, a valve type inkjet nozzle (an example of the valve type nozzle) according to the present invention will be described in detail, based on a preferred embodiment. FIG. 1A is a cross-sectional view of an embodiment of a valve type inkjet nozzle according to the present invention showing a state where an discharge port is closed, FIG. 1B is a cross-sectional view of the embodiment of the valve type inkjet nozzle according to the present invention showing a state where the discharge port is opened.

An illustrated valve type inkjet nozzle 1 schematically includes a hollow nozzle body 4 provided with an discharge port 2 that discharges ink (an example of the liquid) at a tip thereof and provided with an injection port 3 that injects the ink in the vicinity of the discharge port 2, a piezoelectric element 5 that is embedded in the nozzle body 4 and extends and contracts (extends and contracts in a right-left direction of FIGS. 1A and 1B) in accordance with application of a voltage from an outside, a valve element 7 that opens and closes the discharge port 2, a counter-spring mechanism 8 (an example of the moving mechanism) disposed between the valve element 7 and the piezoelectric element 5, a sealing member 6 that is fitted onto the valve element 7 to prevent the ink from flowing into a piezoelectric element 5 side, and a pair of lead wires 9, 10 for voltage application connected to electrodes of the piezoelectric element 5.

Figure 2A:
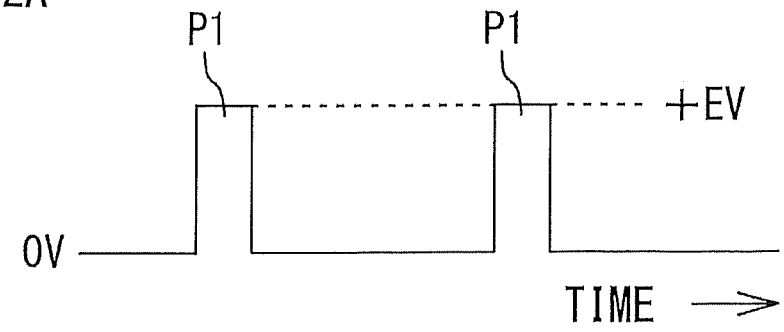
FIGS. 2A to 2C are each a waveform diagram showing an example of an applied voltage to a piezoelectric element.

The nozzle body 4 is formed in a cylindrical shape or a rectangular tubular shape as a whole, and is closed except for the discharge port 2 and the injection port 3. The discharge port 2 is a small opening drilled in the tip of the nozzle body 4, and ink 11 is discharged from the discharge port 2. The injection port 3 is provided on a side surface of the nozzle body 4 in the vicinity of the discharge port 2 and is connected to an ink tank (not shown), and the ink (or paint) is continuously supplied to the valve type inkjet nozzle 1 by pressurizing means (not shown). The piezoelectric element 5 is formed, using zirconia ceramics or the like, and is formed with an appropriate outer shape and thickness in accordance with an amount of the ink 11 to be discharged or the like. Further, for example, a voltage having a waveform as shown in FIG. 2A outputted from a driving part 21 controlled by a controller 20 is continuously applied to the piezoelectric element 5. The sealing member 6 is, for example, a packing, an O-ring or the like, and fitting the sealing member 6 onto the valve element 7 prevents the ink from flowing from the injection port 3 side to the piezoelectric element 5 side. The coating apparatus provided with the valve type inkjet nozzle 1 is configured by disposing a plurality of valve type inkjet nozzles 1 in parallel in which the nozzles 1 discharge inks of different colors.

The counter-spring mechanism 8 is an elastic member formed by molding rubber, soft resin or the like, or a thin metal plate or the like, which are suitably deformable. The counter-spring mechanism 8 has a deformable portion 8*a* having a substantially trapezoidal cross section and formed in contact with a surface on a base end side of the valve element 7 (in FIG. 1A, a right end surface of the valve element 7), a fixed portion 8*b* fixed to an inner wall surface of the nozzle body 4, and a guide portion 8*c* coupled to an end surface of the piezoelectric element 5. A long side (corresponding to a lower base of the trapezoid) of the trapezoidal deformable portion 8*a* is a bending portion 8*d* coupled to the fixed portion 8*b*. In the counter-spring mechanism 8 having the above-described structure, when a predetermined voltage is applied to the piezoelectric element 5 through the driving part 21, the piezoelectric element 5 extends whereby the guide portion 8*c* moves to an discharge port 2 side to press a vicinity of a center portion of the bending portion 8*d* of the deformable portion 8*a*, and a peripheral portion side of the bending portion 8*d* is deformed to be pulled toward the piezoelectric element 5 side. As a result, a top portion (corresponding to an upper base of the trapezoid) of the deformable portion 8*a* coupled to the valve element 7 moves toward the piezoelectric element 5 side (see FIG. 1B). As a result, the valve element 7 is drawn to the piezoelectric element 5 side by a distance d shown in FIGS. 1A and 1B, and the valve element 7 opens the discharge port 2. By appropriately adjusting a length of the bending portion 8*d* and/or a distance from bending portion 8*d* to the top portion which is a coupling portion of the deformable portion 8*a* and the valve element 7, and it is possible to make a movement length of the valve element 7 longer than a extension length of the piezoelectric element 5. That is, the counter-spring mechanism 8 can amplify the slight extension of the piezoelectric element 5. As a result, the length of the expensive piezoelectric element 5 can be made shorter than the conventional one, so that a production cost of the nozzle can be largely reduced. For example, if a moving distance of the valve element 7 is twice a moving distance of the end surface of the piezoelectric element 5, the length of the piezoelectric element 5 can be reduced to about ½ of that of the conventional one.

In this manner, in a state where no voltage is applied to the piezoelectric element 5, the piezoelectric element 5 returns to its original shape, so that no force is exerted on the counter-spring mechanism 8 from the outside, and as shown in FIG. 1A, no deformation occurs. On the other hand, when a voltage of +EV is applied to the piezoelectric element, the piezoelectric element 5 extends and in response to this, the guide portion 8*c* of the counter-spring mechanism 8 moves in a direction of the discharge port 2 (axial direction), so that the deformable portion 8*a* undergoes axial deformation and the deformable portion 8*a* is deformed by compressing as shown in FIG. 1B.

Operation of Valve Type Inkjet Nozzle 1

Figure 2B:
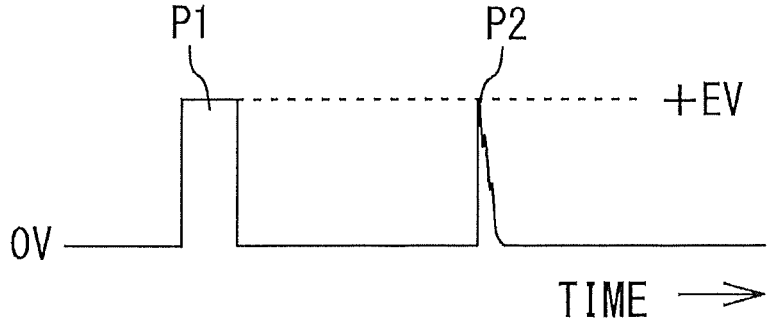
Figure 2C:
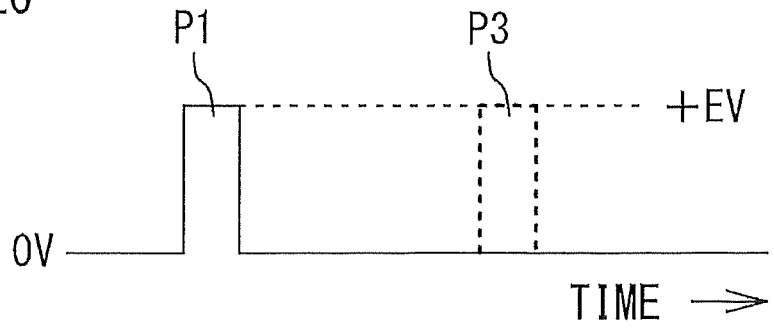
Figure 3A:
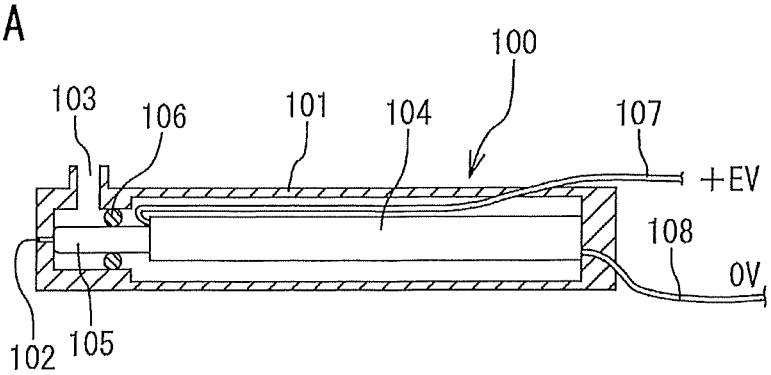
FIG. 3A is a cross-sectional view of an inkjet nozzle using a conventional piezoelectric driving mechanism showing a state where an discharge port is closed.
Figure 3B:
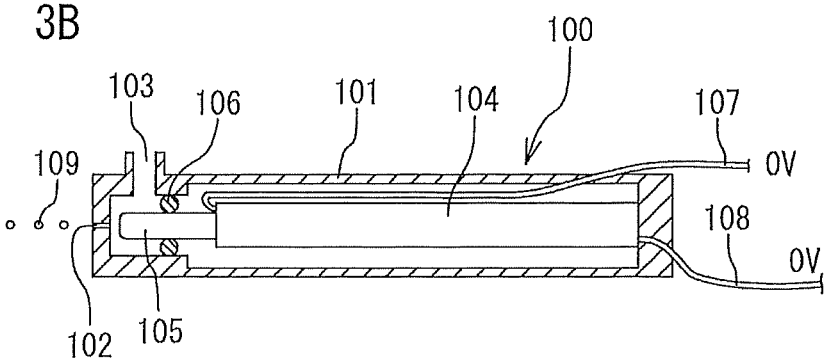
FIG. 3B is a cross-sectional view of the inkjet nozzle using the conventional piezoelectric driving mechanism showing a state where a valve element opens the discharge port.

Next, operation of the above-described valve type inkjet nozzle 1 will be described. FIGS. 2A to 2C are each a waveform diagram showing an example of the applied voltage to the piezoelectric element. In the state where no voltage is applied to the piezoelectric element 5, that is, when the applied voltage=0 V, the deformable portion 8*a* of the counter-spring mechanism 8 is in a bulged state (normal state), the valve element 7 is energized in the direction of the discharge port 2 by an elastic force of the deformable portion 8*a*, the discharge port 2 is closed by an end surface of the valve element 7 as shown in FIG. 1A. Therefore, the ink 11 is not discharged from the discharge port 2.

When a voltage (+EV) of a waveform P1 as shown in FIGS. 2A to 2C is applied to the piezoelectric element 5, the tip (the left end in FIGS. 1A and 1B) of the piezoelectric element 5 extends in the axial direction shown in FIG. 1B, and the guide portion 8*c* moves toward the direction of the discharge port 2 (axial direction). Along with this, the vicinity of the center portion of the bending portion 8*d* of the deformable portion 8*a* is pushed toward the discharge port 2 side (in the direction of arrow a in FIG. 1B), and the peripheral portion of the bending portion 8*d* near the inner wall side of the nozzle body 4 is retracted toward the piezoelectric element 5 side (in directions of arrow b in FIG. 1B), which brings into a state where the deformable portion 8*a* is compressed, so that the length from the bending portion 8*d* of the deformable portion 8*a* to the coupling surface of the valve element 7 is made shorter, and the valve element 7 is drawn toward the piezoelectric element 5 side by the distance d shown in FIGS. 1A and 1B. As a result, a gap as shown in FIG. 1B is generated between a tip surface of the valve element 7 and the discharge port 2, and the discharge port 2 is opened. This allows the injection port 3 to communicate with the discharge port 2, and the ink 11 to be discharged from the discharge port 2.

On the other hand, if a voltage (+EV) of a waveform P2 to the piezoelectric element 5 disappears halfway as shown in FIG. 2B, or if a voltage of a waveform P3 to be applied is not applied to the piezoelectric element 5 due to a power failure or the like as shown in FIG. 2C, the piezoelectric element 5 is returned to the original shape. In other words the counter-spring mechanism 8 is returned to the state shown in FIG. 1A whereby the counter-spring mechanism 8 returns to the original shape. Thereby the valve element 7 closes the discharge port 2, and the ink 11 is not discharged from the discharge port 2. Accordingly even in the case of a power failure or the like, the ink 11 does not leak accidentally from the discharge port 2, and a periphery of the discharge port 2 does not be contaminated and nozzle clogging does not occur.

In this manner, according to the valve type inkjet nozzle of the present embodiment, by interposing the counter-spring mechanism 8 between the piezoelectric element 5 and the valve element 7, when the applied voltage to the piezoelectric element 5 goes down or when a power failure occurs, that is, when the voltage applied to the piezoelectric element 5 is released, the valve element 7 closes the discharge port 2 by the action of the counter-spring mechanism 8, it is possible to prevent the ink 11 from leaking from the discharge port 2.

Further, by interposing the counter-spring mechanism 8 between the piezoelectric element 5 and the valve element 7, the movement length of the valve element 7 can be made longer than the extension length of the piezoelectric element 5 when the predetermined voltage is applied to the piezoelectric element 5, so that the length of the piezoelectric element 5 can be made shorter than that in the conventional valve type inkjet nozzle. For example, if the length of contraction of the counter-spring mechanism 8 is twice the length of extension of the piezoelectric element 5, the length of the piezoelectric element 5 can be reduced to ½ of the conventional one. As a result of the above, it is possible to downsize the expensive piezoelectric element 5, and thus it is possible to largely reduce the production cost of the inkjet nozzle 1.

Other Embodiments

It is to be noted that the present invention is not limited to the above-described embodiment, and various modifications are possible within the scope not departing from or altering the technical idea of the present invention.

For example, at least one of the above-described valve type nozzles is applicable to at least one of the following nozzles of an inkjet printer (an example of the liquid discharge apparatus) and the like.

Figure 4:
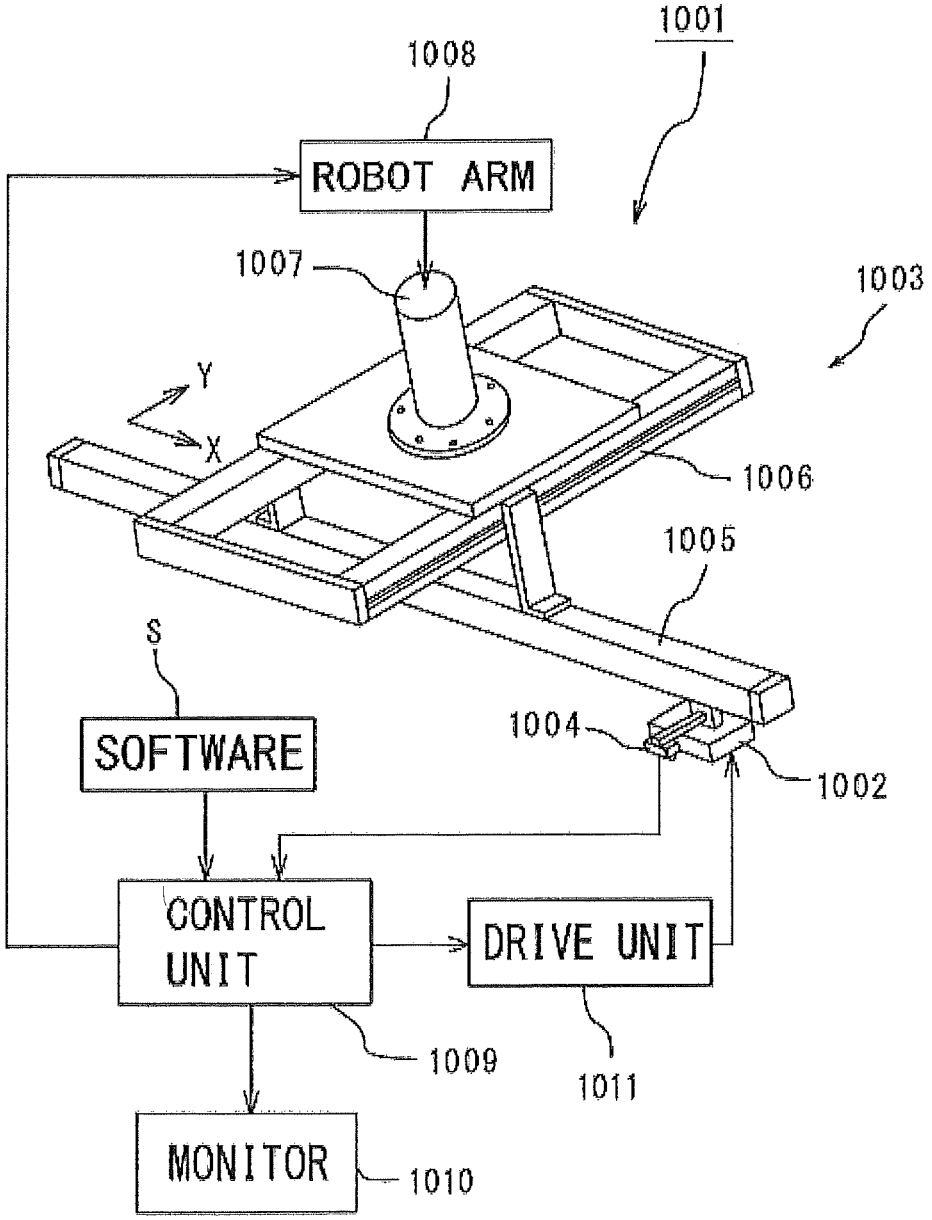
FIG. 4 a configuration diagram illustrating an embodiment of an inkjet printer.

Hereinafter, a configuration of the inkjet printer that implement will be described. FIG. 4 is a configuration diagram illustrating a configuration of an inkjet printer. An inkjet printer 1001 illustrated in FIG. 4 roughly includes a print head 1002 (an example of the liquid discharge head) by an inkjet method, a camera 1004 as a capture unit disposed in the vicinity of the print head 1002, an X-Y table 1003 (an example of the liquid discharge head moving mechanism) that moves the print head 1002 and the camera 1004 in an X direction and a Y direction, a control unit 1009 that operates the X-Y table 1003 and discharges an ink from the print head 1002 to control printing on a print-target surface on the basis of image editing software S for editing an image captured by the camera 1004 and a preset control program, and a drive unit 1011 that causes the camera 1004 and the print head 1002 to be located at predetermined positions on the basis of control from the control unit 1009, and performs capture and print operation.

The print head 1002 includes a plurality of nozzles (not illustrated) that discharges an ink toward a coating-target surface of a coating-target object M. Note that the "ink" referred hereto includes "paint". Inks are discharged through the nozzles perpendicularly to the print head 1002. That is, an ink discharge surface of the print head 1002 is parallel to an X-Y plane formed by the movement of the X-Y table 1003, and ink dots discharged through the nozzles are discharged in a direction perpendicular to the X-Y plane. In addition, discharging directions of the inks discharged through the nozzles are parallel to one another. The nozzles are respectively connected with ink tanks of predetermined colors, and the ink tanks are pressurized by a pressurizing device (not illustrated). The nozzles can discharge the ink dots to a print surface of the coating-target object M without problems as long as the distance between the nozzles and the print surface is about 20 cm.

Figure 5:
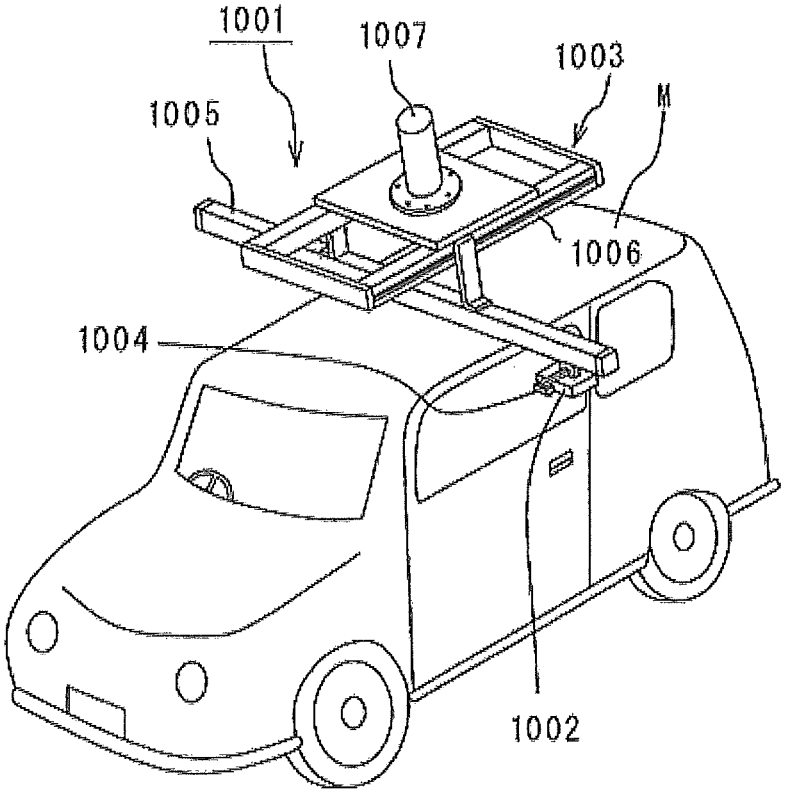
FIG. 5 is an explanatory diagram illustrating an arrangement example of the inkjet printer illustrated in FIG. 4 for an automobile that is an object to be printed.
Figure 6:
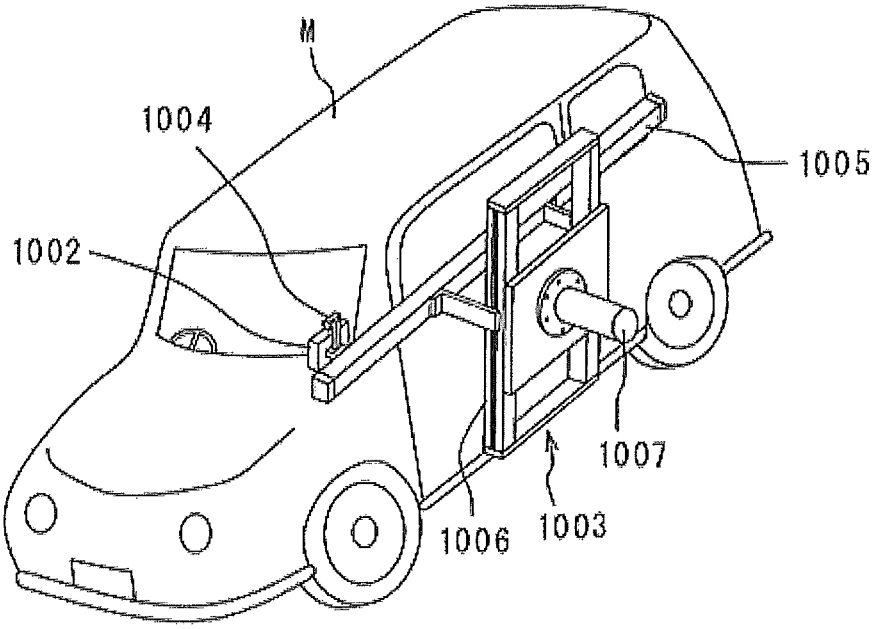
FIG. 6 is an explanatory diagram illustrating another arrangement example of the inkjet printer illustrated in FIG. 4 for the automobile to be printed.

The X-Y table 1003 roughly includes an X shaft 1005 formed with a linear movement mechanism, and a Y shaft 1006 that moves the X shaft in the Y direction while holding the X shaft 1005 with two arms, and the print head 1002 and the camera 1004 described below are attached to a slider (not illustrated) of the X shaft. A shaft 1007 is provided on the Y shaft 1006 and is held by a robot arm 1008, whereby the print head 1002 can be freely arranged at a predetermined position where printing is to be performed on the coating-target object M. For example, in a case where the coating-target object M is an automobile, the print head 1002 can be arranged at a side position as illustrated in FIG. 5 or arranged on an upper portion as illustrated in FIG. 6. Note that the operation of the robot arm 1008 is controlled on the basis of a program stored in advance in the control unit 1009.

The camera 1004 is disposed on a slider (not illustrated) of the X shaft 1005, which is a vicinity of the print head 1002, and captures a predetermined area of the print-target surface of the coating-target object M at fixed intervals while moving in X-Y directions. The camera 1004 is a so-called digital camera, and a specification of a lens that can capture a plurality of subdivided images for the predetermined area of the print-target surface, as described above, and specifications of a resolution and the like are appropriately selected. The capturing of the plurality of subdivided images of the print-target surface by the camera 1004 is continuously and automatically performed according to a program provided in advance in the control unit 1009.

Figure 7A:
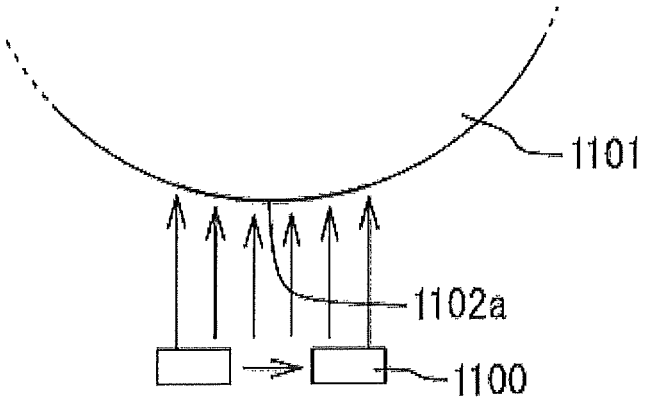
FIG. 7A is an explanatory diagram of a case where an image is printed on a spherical surface by an inkjet printer.
Figure 7B:
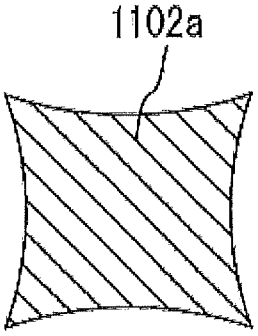
FIG. 7B is an explanatory diagram illustrating a result of a case where a rectangle is printed on a spherical surface.
Figure 7C:
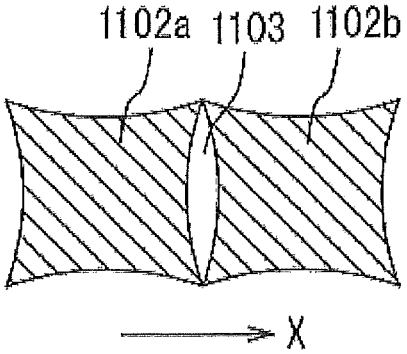
FIG. 7C is an explanatory diagram of a case where rectangles are continuously printed on a spherical surface by an inkjet printer.

The control unit 1009 is configured by a so-called micro-computer including a storage device that records and stores various programs, data of captured images, data of images to be printed, and the like, a central processing unit that executes various types of processing according to a program, an input device such as a keyboard and a mouse, and a DVD player and the like as needed. Further, a monitor 1010 is included, and the monitor 1010 displays input information to the control unit 1009, a processing result by the control unit 1009, and the like. As will be described below, the control unit 1009 performs image processing for a plurality of subdivided image data captured by the camera 1004 using image processing software, generates a composite print surface that is a plane projection of the print-target surface which is non-plane of the coating-target object M, and generates an edited image to be drawn B by superimposing, on the composite print surface, an image to be drawn A that is an image to be printed contiguous to an printed image previously printed on the print-target surface, and editing the image to be drawn A to be continuous with an end edge portion of the printed image. For example, the control unit 1009 generates, regarding a print image 1102*b* (corresponding to the image to be drawn A) illustrated in FIG. 7C, the edited image to be drawn B by editing (deforming) the print image 1102*b* to be consistent with the composite print surface so as not to form a non-print area 1103 between the print image 1102*b* and an adjacent print image 1102*a*. Then, by actually performing printing by the print head 1002 on the basis of the edited image to be drawn B, the print image 1102*b* can be printed without a gap between the print image 1102*b* and the printed print image 1102*a*. Note that implementation of the capturing of the plurality of subdivided images by the camera 1004 and the printing by discharge of the inks through the nozzles of the print head 1002 is performed by the drive unit 1011, the operation of which is controlled by the control unit 1009.

In this application, the term "liquid discharge apparatus" denotes an apparatus including a liquid discharge head or a liquid discharge device (e.g., a liquid discharge unit) to discharge liquid by driving the liquid discharge head. The liquid discharge apparatus includes an apparatus capable of discharging liquid to a material onto which liquid adheres and an apparatus to discharge liquid toward gas or into liquid.

The liquid discharge apparatus includes devices to feed, convey, and eject the material onto which liquid adheres. The liquid discharge apparatus further includes a pretreatment device to apply treatment liquid to the material before liquid is discharged onto the material and a post treatment device to apply treatment liquid to the material after liquid is discharged onto the material.

The liquid discharge apparatus is, for example, an image forming apparatus to form an image on a sheet by discharging ink or a three-dimensional fabricating apparatus (e.g., a solid-object fabricating apparatus) to discharge fabrication liquid to a powder layer in which powder is formed in a layer, so as to form a three-dimensional fabrication object (e.g., a solid fabrication object).

The liquid discharge apparatus is not limited to an apparatus to discharge liquid to visualize meaningful images such as letters and figures. For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material onto which liquid adheres unless particularly limited.

Examples of the material onto which liquid adheres include any materials onto which liquid adheres even temporarily, such as paper, thread, fiber, fabric, leather, metal, plastic, glass, wood, ceramics, building materials (e.g., wallpaper and a flooring material), and a cloth textile.

Examples of the liquid are substances having viscosity or surface tension that can be discharged from the head. Examples of the liquid are not particularly limited, but they are preferably substances that have a viscosity of 30 mPas or less at a normal temperature and pressure or at a heating or cooling environment.

More specifically, examples of the liquid include solvents such as water and organic solvents, colorants such as dyes and pigments. In addition, examples of the liquid include a functional material such as a polymerizable compound, a resin, and a surfactant, a biocompatible material such as a DNA, an amino acid, a protein and a calcium, edible material such as natural coloring matter. In addition, examples of the liquid include solutions, suspensions, or emulsions containing them and the like.

Uses of the above liquids are for example ink of inkjet, surface treatment, forming a constituent element of an electronic element or light emitting element, forming an electronic circuit resist pattern, or solution for forming a three-dimensional modeling material, and the like.

The liquid discharge apparatus includes an apparatus to relatively move the liquid discharge head and the material onto which liquid adheres. However, the liquid discharge apparatus is not limited to such apparatus. For example, the liquid discharge apparatus is a serial head apparatus that moves the liquid discharge head, a line head apparatus that does not move the liquid discharge head, or the like.

Examples of the liquid discharge apparatus further include a treatment liquid coating apparatus to discharge treatment liquid onto a sheet to coat a surface of the sheet with the treatment liquid to reform the surface of the sheet and an injection granulation apparatus in which composition liquid including raw materials dispersed in a solution is injected through nozzles to granulate fine particles of the raw materials.

What is claimed is:

1. A valve type nozzle that controls discharge of a liquid, the valve nozzle comprising:

a nozzle body;

a discharge port configured to discharge the liquid;

an activation element;

a valve element that moves through activation of the activation element; and an elastic member provided between the activation element and the valve element, wherein the elastic member includes:

a deformable portion connected to an end of the valve element;

a fixed portion fixed to the nozzle body;

a guide portion connected to an end of the activation element; and a bending portion connected to the fixed portion, wherein, when the activation element deforms toward the discharge port side, the guide portion presses the bending portion, and the bending portion moves the deformable portion and the valve element to a side reverse to a side at which the discharge port is provided, and wherein, when the activation element deforms toward the side reverse to the side at which the discharge port is provided, a force with which the guide portion presses the bending portion is reduced, and the bending portion moves the deformable portion and the valve element to the side at which the discharge port is provided.

2. The valve type nozzle according to claim 1, wherein the deformable portion has a trapezoidal shape when viewed from a direction intersecting with a liquid discharge direction.

3. The valve type nozzle according to claim 2, wherein when viewed from the direction intersecting with the liquid discharge direction, a side of the deformable portion at the valve element side is shorter than a side of the deformable portion at the bending portion side.

4. The valve type nozzle according to claim 1, wherein when viewed from a direction intersecting with a liquid discharge direction, the discharge port, the deformable portion, the bending portion, the fixed portion, the guide portion, and the activation element are arranged in the stated order.

5. The valve type nozzle according to claim 1, further comprising a sealing member provided between the nozzle body and the valve element.

6. The valve type nozzle according to claim 5, wherein when viewed from a direction intersecting with a liquid discharge direction, the sealing member is provided between the discharge port and the deformable portion.

7. The valve type nozzle according the claim 1, wherein a moving distance of the valve element is twice a moving distance of an end surface of the activation element.

8. The valve type nozzle according to claim 1, wherein an end of the activation element at a side reverse to a side at which the guide portion is connected is fixed to the nozzle body.

9. The valve type nozzle according to claim 1, wherein the activation element extends in a liquid discharge direction in response to a voltage being applied to the activation element.

10. The valve type nozzle according to claim 1, wherein the activation element is an piezoelectric element, and the activation element is activated through the application of a predetermined voltage to the piezoelectric element.

11. A liquid discharge apparatus including the valve type nozzle according to claim 1.

* * * * *